United States Patent [19]

Argyropoulos et al.

[11] Patent Number: 4,472,196

[45] Date of Patent: Sep. 18, 1984

[54] EXOTHERMIC ALLOY FOR ADDITION OF ALLOYING INGREDIENTS TO STEEL

[75] Inventors: Stavros A. Argyropoulos, Verdun, Canada; Paul D. Deeley, Ocean City, N.J.

[73] Assignee: Shieldalloy Corporation, New York, N.Y.

[21] Appl. No.: 504,217

[22] Filed: Jun. 14, 1983

[51] Int. Cl.[3] ..... B22F 1/00

[52] U.S. Cl. ..... 75/129; 75/228; 75/255

[58] Field of Search ..... 75/129, 228, 255

[56] References Cited

U.S. PATENT DOCUMENTS

| | | | |
|---|---|---|---|
| 3,717,442 | 2/1973 | Knopp | 75/255 |
| 4,101,319 | 7/1978 | Beyer | 75/255 |
| 4,108,646 | 8/1978 | Gennone | 75/228 |

*Primary Examiner*—Peter D. Rosenberg

*Attorney, Agent, or Firm*—Hopgood, Calimafde, Kalil, Blaustein & Judlowe

[57] ABSTRACT

An addition agent and method are provided for adding alloying ingredients to a molten steel bath comprising a P/M compact formed of a compacted mixture of a particulate primary addition alloy and at least one secondary particulate metal. The primary particulate addition alloy is formed of a plurality of elemental metals at least one of which is present in substantial amounts and which primary addition alloy when added to the steel bath alone has a dissolution rate in said bath characteristic of said primary alloy. The at least one secondary particulate component is also an additive to said steel bath and is characterized by being exothermically reactable with said substantial amount of elemental metal in said primary addition alloy so that additional heat is generated when the P/M compact is added to the molten steel bath, whereby the dissolution rate of the primary addition alloy in the compact is substantially increased over the characteristic dissolution rate of the same primary addition alloy when added to the steel bath alone.

56 Claims, 15 Drawing Figures

EXOTHERMIC ALLOY FOR ADDITION OF ALLOYING INGREDIENTS TO STEEL

This invention relates to addition agents for use in molten metals and, in particular, to addition agents which have been modified to improve their dissolution rates in molten metal baths, such as molten steel baths.

FIELD OF THE INVENTION

Alloy addition agents are employed in the production of low alloy steels in order to impart special physical properties thereto. As pointed out in U.S. Pat. No. 2,935,397, since commercial open hearth furnaces are tapped in about five minutes, it is important that such alloy agents be characterized by a rapid dissolution rate. Additions of loose, finely comminuted alloys to achieve rapid solution generally result in low recoveries due to air oxidation at the surface of the steel bath. In recent years, exothermic ladle additions comprising crushed addition alloys in briquetted or aggregated form containing chemicals, which react to evolve heat, have been employed to promote rapid dissolution. However, as pointed out in the aforementioned patent, while this method has been satisfactory in most respects, an attendant disadvantage is that the exothermic reaction generally yields end products which contaminate the melt to some extent. As illustrative of this, the patent refers to the use of commercial addition agents containing sodium nitrate as the oxidant which generates nitrogen gas as an end product which has a contaminating effect on the final steel product.

In light of the foregoing problems, the patent provides non-exothermic alloy mixtures containing an organic binder. The addition agent may comprise 88% to 99.5% of finely divided alloying materials, 0.5% to 12% of a finely divided organic binder selected from the group consisting of abietic acid, complexes thereof and wood rosins, up to 10% of a fluxing agent, and up to 5% aluminum. One example comprised electrolytic manganese bonded with about 1.8% wood rosin which was said to dissolve quickly in the bath. The organic binder generates gases which inhibits oxidation of the addition alloy during its dissolution. However, the patent does state that when using highly oxidizable metals, such as titanium, as an addition agent, aluminum and a flux (e.g., $CaF_2$) are used as part of the mixture. However, fluxes are not generally desirable since they can also contaminate the steel.

Because non-metallic inclusions are not desirable in steels generally, a method is proposed in U.S. Pat. No. 3,459,540 for limiting non-metallic inclusions in steels and for producing fine grain steels using a granular compacted iron, aluminum and niobium composition which is introduced into the melt at a predetermined rate. The purpose is to limit the formation of such inclusions as alumina and alumina silicates by adding to the molten iron which has been deoxidized a packaged mixture containing by weight 25% to 50% aluminum, 30% to 50% niobium and the remainder principally iron with incidental impurities.

A well known addition agent for the production of low alloy steels containing small amounts of columbium is a ferrocolumbium alloy. A typical ferrocolumbium alloy is one containing by weight about 60 to 70% Cb and the balance substantially iron. One method of using this addition agent is to add it to the ladle during tapping. Because the transition time from tapping to casting is necessarily short, the ferro-alloy should dissolve as rapidly as possible. However, as discussed in U.S. Pat. No. 3,445,223, there are numerous disadvantages in the use of ferrocolumbium (i.e., ferroniobium) as a source of columbium. A first disadvantage is that the alloy has a density substantially greater than steel and, therefore, sinks to the bottom of the ladle. Second, and most importantly, ferrocolumbium has a relatively slow dissolution rate in molten steel at the normal tapping temperature of steel. Another disadvantage is the tendency for columbium to form oxide. These properties of ferrocolumbium result in incomplete solution of ferrocolumbium in the steel, inconsistent and low recoveries of columbium and also non-uniform distribution of columbium within the heat. The final amounts of columbium remaining in the steel are critical, when one considers the amounts added are small and may be of the order of 0.02% to 0.04% by weight and as high as 0.10%. For example, a difference of 0.005% columbium based on a target of 0.02% results in a 20% variation.

U.S. Pat. No. 3,445,223 proposes to overcome the aforementioned problems by providing a ternary alloy consisting essentially by weight of 20% to 35% Cb, 15% to 30% Mn, 15% to 35% Si and the balance iron and incidental impurities. In other words, the alloy is in a completely pre-reacted state. Tests showed the ternary alloy to have a faster dissolution rate in steel than the ferrocolumbium alloy (66.7% Cb). However, a disadvantage of using high amounts of manganese and silicon in the alloy is the tendency for these elements to form non-metallic inclusions in the final steel product, especially where deoxidation of the steel was not complete.

The factors influencing the dissolution rate of ferro-alloys has been discussed in the literature. A publication in particular is the paper by S. A. Argyropoulos and R. I. Guthrie entitled "Dissolution Kinetics of Ferro-alloys In Steelmaking". Steelmaking Proceedings, Volume 65, Pittsburgh, 1982, pp. 156–167.

In this paper, a review is given of the various ways in which lumps of ferro-alloys are dissolved in molten steel. Broadly, two categories can be identified depending on whether the melting range of the addition alloy lies below or lies above the freezing point of steel. The paper defines a Class I ferro-alloy as one having a melting point or melting point range which lies below the steels freezing point (i.e., about 1500° to 1520° C.). In this instance, the absorption of the ferro-alloy occurs via a melting phenomenon in which the alloys' thermal properties, those of the bath and bath temperatures, govern dissolution times. Typical of Class I addition alloys are ferromanganese, silicomanganese, ferrochrome and ferrosilicon additions.

The Class II ferro-alloys are defined as those having melting points or melting point ranges which lie above the melting point of steel.

In both instances when the addition agent is plunged into the bath as a lump or a briquette, it is immediately covered by a shell of solidified steel. In the case of the Class I alloy, the shell generally still surrounds the ferro-alloy lump as the latter begins to melt and very often the addition alloy is totally melted before the surrounding shell of steel has melted back. When the shell disappears, the encased molten addition alloy immediately dissolves into the steel bath.

In the case of the Class II alloys with the melting point or melting point ranges above the melting point of steel, a different dissolution phenomenon is involved.

First, the shell of frozen steel melts back to expose the unmelted lump to the steel bath and then diffusion of the solute material through a liquid phase mass transfer boundary layer into the bulk of the steel bath occurs which regulates solution kinetics. These are mainly affected by the alloys' solubility and diffusivity in molten steel and by attendant hydrodynamics. Since mass transfer kinetics are typically at least one order of magnitude slower than heat transfer kinetics for liquid metal systems, the time taken to effect dissolution of the exposed alloy (after complete melt-back of the steel shell) is of dominant importance. Thus, for the Class II alloy, one can generally consider a short steel shell period followed by a substantially longer dissolution period of the exposed unmelted alloy.

To the extent that the aforementioned paper is helpful for explaining the dissolution kinetics of addition alloys, the disclosure thereof is incorporated herein by reference.

As stated in the paper, the rate of shell melt-back is governed by convective heat transfer processes from the bath and, as such, depends on bath hydrodynamics (i.e., stirring).

The ferrocolumbium alloy which has a melting point or melting range above that of steel, in particular presents the problem of slow dissolution kinetics as pointed out in U.S. Pat. No. 3,445,223.

Since the formation of a steel shell around the addition alloy adds to the dissolution time of the addition alloy, be it a Class I or Class II alloy, it would be desirable to provide a method whereby the dissolution rates of such alloys are substantially improved by increasing the rate of dissolution or melt-back of the steel as well as the rate at which the addition alloy enters the bath.

We have found that this can be achieved by taking the commercial addition alloy (primary alloy) in particulate form and, depending upon its composition, mixing with it a particulate secondary metal or binary alloy and form a briquette thereof, whereby the dissolution rate of said addition alloy is markedly improved when the briquette is added to the bath, so long as the secondary metal is exothermically reactable with one of the alloying components of the primary addition alloy. In this method heat transfer kinetics is relied upon as a result of heat generated from within the briquette, even while still covered by a steel shell.

OBJECT OF THE INVENTION

It is an object of the invention to provide a means for improving dissolution rates of addition alloys in molten metal baths.

Another object is to provide as an article of manufacture an addition agent for use in producing alloys with other metals.

Another object is to provide an addition agent in the form of briquettes for use in molten steel baths, wherein the dissolution rate of said agent is markedly improved.

These and other objects will be clearly apparent from the following disclosure, the appended claims and the accompanying drawings wherein:

Figure 15:
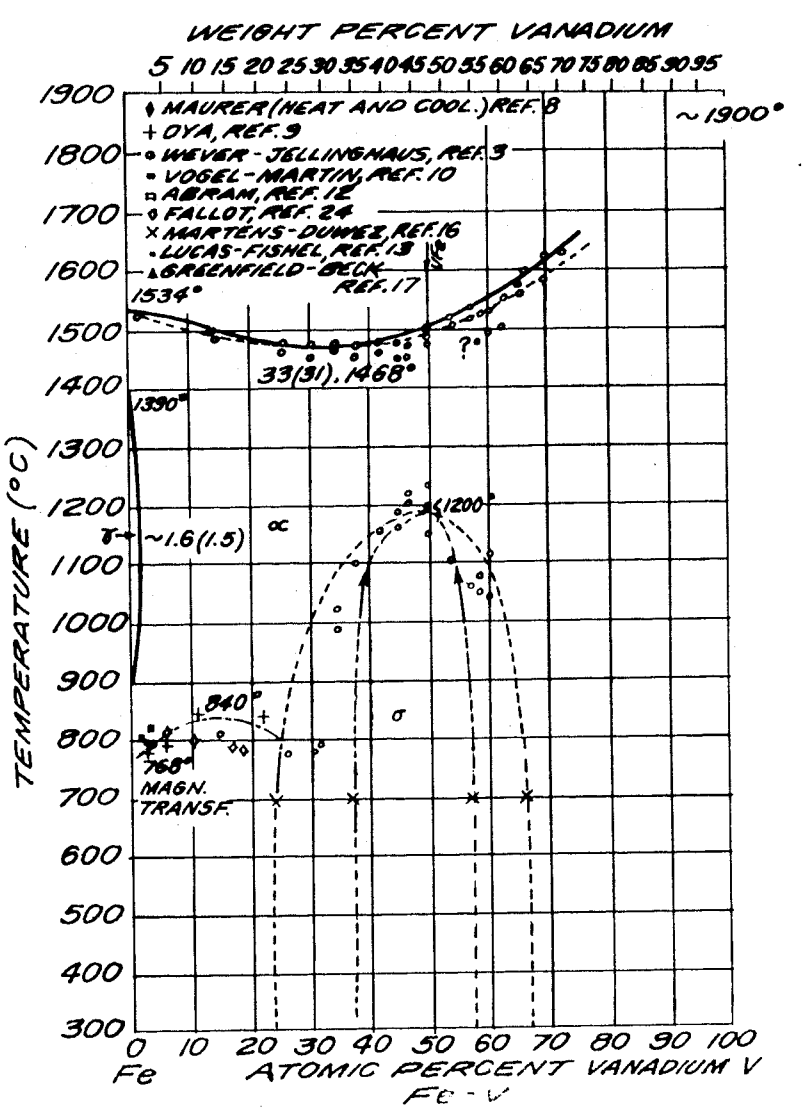
Figure 14:
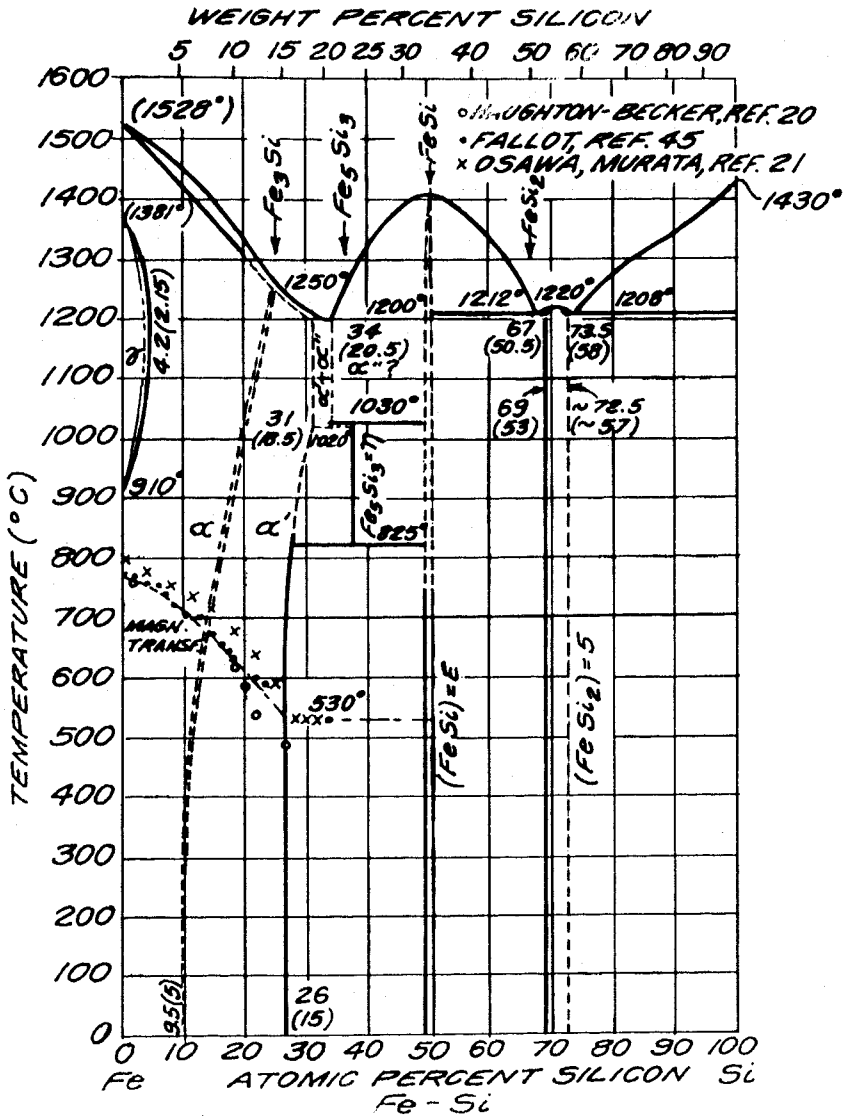

FIG. 14 is a binary of the iron-silicon system showing several eutectics and in which the melting points or ranges of iron alloys containing 20% to 80% silicon are below the melting point of steel; and FIG. 15 depicts a binary of the system iron-vanadium showing no eutectics and in which the melting points or ranges of iron alloys containing 20% to 80% vanadium are either below or above the melting point of steel.

SUMMARY OF THE INVENTION

A preferred embodiment of the invention resides in an addition agent for molten metal baths comprising a P/M (powder metallurgy) compact of a particulate primary addition alloy of an alloy system A-B characterized by at least one eutectic and at least one intermetallic compound, said primary alloy being mixed with at least one metal powder selected from the group consisting of metals A and B, the selection of A or B powder in the compact being correlated to the composition of the primary alloy AB. By the term "primary addition alloy" is meant that addition alloy whose dissolution rate is to be improved.

The metal powder selected for mixing with the particulate primary alloy depends on the composition of alloy AB, such that where the primary alloy contains substantial amounts of metal A which is not wholly stoichiometrically combined with B as an intermetallic compound, substantially metal powder B is employed in admixture with particulate primary alloy AB. Where the primary alloy AB contains substantial amounts of metal B which is not wholly stoichiometrically combined with metal A as an intermetallic compound, substantially metal powder A is employed in admixture with particulate primary alloy AB.

The ultimate mixture is such that when the compacted mixture is added to the molten metal bath, the dissolution rate of the primary addition alloy is substantially increased over the dissolution rate of the same primary alloy AB when added to the molten bath alone.

The foregoing technique is applicable to the production of low, medium or high alloy steels, nickel-base alloys and to the production of other base metal alloys as well.

Another embodiment resides in an addition agent for adding alloying ingredients to molten steel baths in which the P/M compact comprises a mixture of a particulate primary addition alloy and at least one secondary particulate metal selected from the group consisting of an elemental metal component and a binary alloy component. The primary particulate alloy is formed of a plurality of elemental metals at least one of which is present in substantial amounts which primary alloy when added to the steel bath alone has a dissolution rate in the steel bath characteristic of the primary alloy.

By mixing the primary alloy with at least one secondary particulate metal component which is also an additive to the steel bath and which is exothermically reactable with the substantial amount of elemental metal in said primary alloy, a heat generatable compact is provided which markedly improves the dissolution rate of the primary addition alloy contained therein as compared to the dissolution when the primary addition is added to the steel bath alone. This embodiment is applicable to alloy systems which do not have eutectics as well as those that do have eutectics.

DETAILS OF THE INVENTION

The invention is particularly applicable to the formulation of addition agents for low alloy steels, such as steels containing small amounts of columbium, vanadium, and the like. An example of a low alloy steel is one containing columbium in the range of about 0.02% to 0.04% by weight and which may range as high as about 0.1%.

By simply briquetting a mixture of a conventional ferrocolumbium alloy (containing 60 to 70% Cb) with iron powder and adding the briquette to a molten steel bath, the dissolution rate of the ferrocolumbium alloy is markedly increased to a full order of magnitude or more. An advantage of this mixture is that the self-generated exothermic reaction results in a clean, non-slag forming, molten form which is easily and swiftly dispersed in the steel bath. It is commonly known in steel making that ferrocolumbium is difficult to use both from the erratic, and frequently, lower recovery aspect. Columbium treated steels are subject to variations in physical properties as a function of the variation in columbium content. The invention overcomes these problems by assuring high recovery efficiencies and reproducibility.

Before providing an example of the invention, it would be helpful at this juncture to consider the theoretical aspects of the iron-columbium system. A mixture of elemental iron and elemental columbium in powder form can react together at a temperature of about 1370° C. or 1643° K. (a eutectic temperature) to form the intermetallic compound $Fe_2Cb$. The reaction which takes place can be written as follows:

$$0.667Fe + 0.333Cb \rightarrow Fe_{0.667}Cb_{0.333} \quad (1)$$

The ΔH of the reaction is −13075 cal/gram atom (Hultgren et al; Selected Values of The Thermodynamic Properties of Binary Alloys; Metal Park, 1973, pp. 844–846). This value remains practically the same if the reaction takes place at 1600° C. (1873° K.), a typical steelmaking temperature. According to theory, the product of reaction 1 is a solid if the heat generated by this reaction is removed. Since the exothermic reaction proceeds rather swiftly and is substantially an adiabatic one, the heat generated immediately raises the temperature of the product (i.e., $Fe_{0.667}Cb_{0.333}$ or $Fe_2Cb$) to its melting point. According to the Fe-Cb binary diagram of FIG. 13, the melting point is 1655° C.

The heat which is required to increase the temperature of reaction (1) hereinabove can be calculated as follows $$\Delta H = Cp \times \Delta T = 7.25 \times (1928° - 1873° \text{ K.}) = 398 \text{ cal} \quad (2)$$

$$Cp = 7.25 \text{ cal/gram atom} \quad (3)$$

As there is no available experimental data for the heat of melting of $Fe_2Cb$, the procedure suggested by Kubaschewski and Alcock was used (Metallurgical Thermochemistry, 5th Edition, 1979, p. 183, published by Pergamon Press Ltd.). Where the heat of fusion of an alloy is unknown, the value of:

3.5×melting point in °K. for ordered or 2.3×melting point in °K. for disordered structures may be used.

Thus, the ΔH melting may be calculated as follows:

$$\Delta H \text{ melting} = 3.5 \times 1928° \text{ K.} = 6748 \text{ cal/gram atom} \quad (4)$$

$$\Delta H \text{ melting} = 2.5 \times 1928° \text{ K.} = 4434 \text{ cal/gram atom} \quad (5)$$

The value obtained for (4) assumes that $Fe_2Cb$ has an ordered structure; whereas, the value for (5) assumes that $Fe_2Cb$ has a disordered structure. In the calculations used herein, an ordered structure was assumed as in (4).

Assuming that the temperature of the Fe and Cb compact (i.e., mixture of elemental Fe and Cb) is brought to 1600° C. (1873° K.) (a typical steelmaking temperature), the heat that is released, assuming that the product of reaction is a liquid, is as follows:

$$\Delta H \text{ (total)} = \Delta H_1 + \Delta H_2 + \Delta H_3$$

where

| | |
|---|---|
| $\Delta H_1$ = | −13075 cal/gram atom (Heat of mixing of Fe + Cb) |
| $\Delta H_2$ = | 6748 cal/gram atom (Heat of melting of $Fe_2Cb$) |
| $\Delta H_3$ = | 398 cal/gram atom (The heat to increase the temperature from 1873° K. (1600° C.) to 1988° K. (1715° C.). |
| ΔH (total) = | −5928 cal/gram atom. |

The foregoing value clearly shows that the heat which is released from the intermixing of Fe and Cb is capable of increasing the temperature of the resultant $Fe_2Cb$ above its melting point. Thus, it is expected that the transfer of Cb to the liquid steel to follow the melting mechanism instead of the dissolution mechanism. In this way, the mass transfer of Cb to liquid steel can be accelerated.

In a similar manner, the heat which is released from the mixing of 100 grams of particulate conventionally cast Fe-Cb alloy (containing 75% Cb) with 65.3 grams of powdered iron would be about −5601 calories/gram atom.

Likewise, a compact comprised of 100 grams of particulate Fe-Cb alloy (containing about 69% by weight Cb) admixed with 43.2 grams of powdered Fe results in a heat release of about −1318 cal/gram atom. In all cases, the amount of heat is sufficient to melt $Fe_2Cb$.

To illustrate the foregoing, several tests were conducted on particulate conventionally cast Fe-Cb alloy in which the alloy was mixed with iron in one instance and used simply as the alloy per se in another instance, both being used in the form of a P/M (powder metallurgy) compact. The composition of the Fe-Cb alloy employed and the particle size distribution is given as follows:

TABLE I

| Chemical Analysis* | | Screen Analysis** | |
|---|---|---|---|
| Cb | 69.28% | +50 mesh | 0.0 |
| Ta | 0.29% | +60 | trace |
| Mn | 0.27% | +80 | 23.0 |
| Ti | 1.80% | +100 | 10.0 |
| Si | 1.85% | +200 | 30.0 |
| Sn | 0.078% | +325 | 15.0 |
| Al | 3.31% | −325 | 22.0 |
| C | 0.18% | | |
| S | 0.001% | | |
| Fe | bal. | | |

*% by weight
**U.S. Standard

An iron powder designated by the trade name Ancorsteel 1000 G (supplied by the Hoeganes Corporation) was used for mixing with the alloy, the iron having the following analysis:

TABLE II

| Chemical Analysis | | Screen Analysis | |
|---|---|---|---|
| C | 0.01% | +60 mesh | trace |
| S | 0.01% | +100 | 13.5% |
| $H_2$-Loss | 0.14% | +325 | 72.0% |
| Fe | bal. | −325 | 14.5% |
| Apparent Density | 2.50 g/cm$^3$ | | |

The tests conducted are given in the following Examples.

EXAMPLE 1

Figure 1:
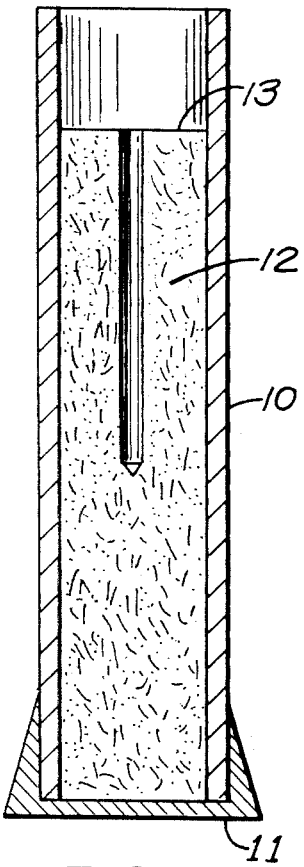
FIG. 1 is a schematic of a compact in cross section of ferrocolumbium.

A mixture comprising 500 grams of ferrocolumbium (see Table I) was mixed with 302 grams of iron powder (see Table II) using a vibrator mixer for 1 hour. The final mix was inserted into a cylindrical steel tube and a pressure of 10 tons applied. FIG. 1 is a schematic in cross section showing the steel tube 10 with a cup-shaped bottom 11 fitted thereto and containing the compacted mixture 12. After fabrication of the compact, a hole 13 was drilled in the center thereof of about ⅛ inch in diameter and about 2.5 inches long. In this hole a thermocouple of the R type was inserted (i.e., Platinum-Platinum 13% Rhodium). The bottom 11 was machined from mild steel and force-fitted onto the end of the cylinder as shown.

In carrying out the test, 65 kgs. of Armco iron (iron with very low carbon) were melted in an induction furnace, during which the heat was deoxidized by the proper addition of deoxidants to assure reduction of the oxygen content before adding the alloying elements. The temperature of the steel bath was measured using a protected thermocouple which was inserted in the bath and maintained there during the short period measurements were taken.

Figure 2:
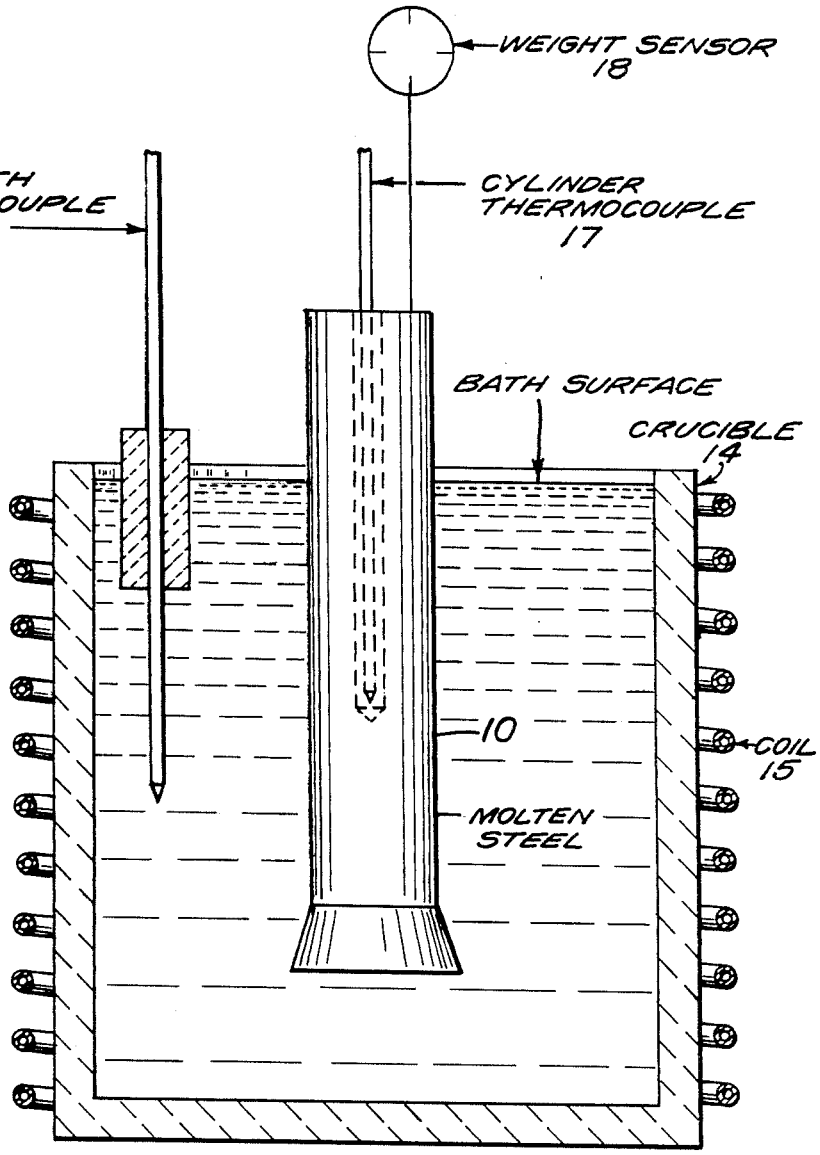
FIG. 2 is a schematic of an induction melting crucible showing the compact inserted in a molten steel bath.

The compact, of course, had its thermocouple as mentioned hereinabove. During the time period of which readings were taken, the apparent weight of the compacted composition was measured with a weight sensor (i.e., a load cell). A schematic of the induction furnace is shown in the cross section of FIG. 2 comprising a ceramic crucible 14 surrounded by an induction coil 15 coupled to a source of electrical power not shown. The copper coil is hollow and is water cooled in the usual manner. The relative proportions of the elements making up the figure are exaggerated in size for purposes of clarity. The bath temperature is measured by thermocouple 16, the temperature of compact 12 being measured by thermocouple 17. A weight sensor 18 (a load cell) is provided for recording the weight of the compact up to the point of melting.

Figure 3:
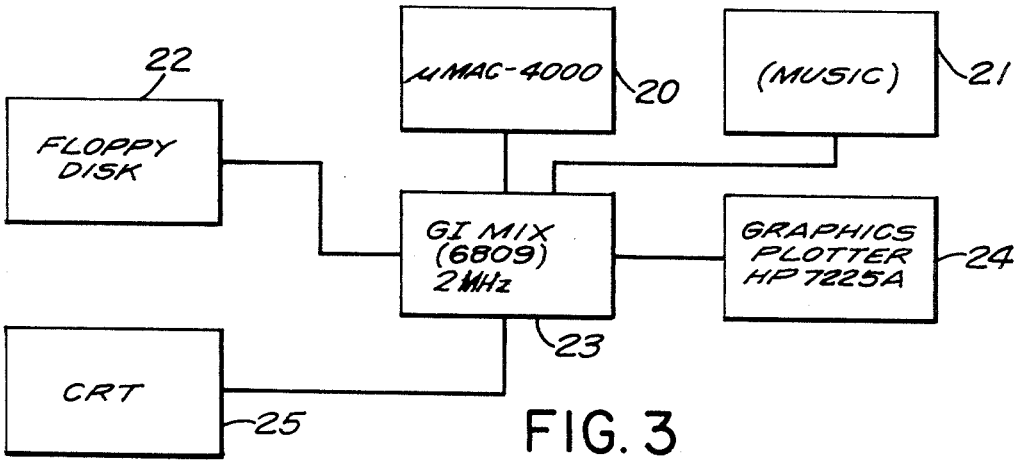
FIG. 3 is a block diagram of the control system employed in recording the experimental data.

The analog signals from these sensors are fed to a microprocessing system depicted generally by the integrated block diagram shown in FIG. 3, the signals being fed to block 20 referred to as μMAC-4000 for data acquisition and process control. This system is capable of doing precise measurements in harsh metallurgical environments. With this system the outputs of the two thermocouples and the weight sensor were measured continuously at a rapid rate of four times every second. This high rate of measurement is very important in view of the complexity and importance of the parameters being measured.

Referring to the block diagram of FIG. 3, GIMIX (identified by numeral 23) is the host computer and μMAC-4000 is the satellite microperipheral connected to GIMIX for interfacing with the real world, such as signals from the thermocouples which measure the temperature of the bath and of the compact, signals from the load cell which measures apparent weight of the compact, etc.

The analog signals are fed to μMAC-4000 which then transmits digital signals to the host GIMIX microcomputer. Block 25 labeled CRT is the terminal screen by means of which the operator is enabled to control the experiment. Block 22 labeled Floppy Disk is a storage medium for storing information to be fed to and for receiving information from GIMIX. Block 21 labeled MUSIC is an acronym which means "system for interactive computing", that is, it is a centralized computing facility to which the host computer (GIMIX) is connected.

Graphic plotter 24 is interfaced with the host GIMIX computer and produces graphs at the end of the experiments, such as the graphs shown in FIGS. 4 to 12.

Figure 4:
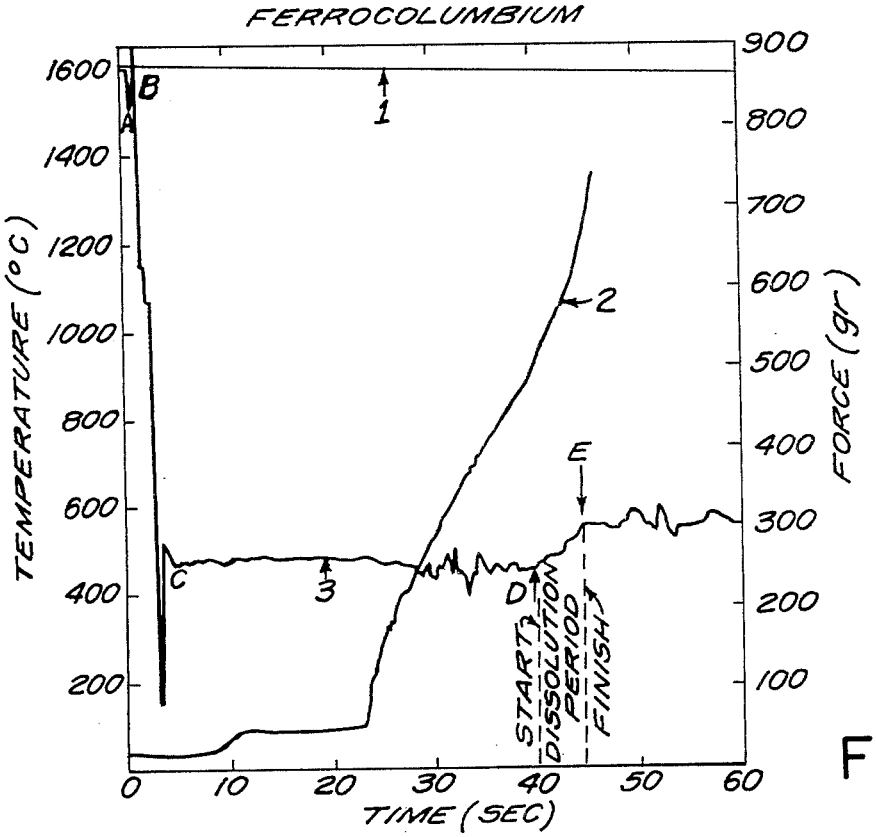
FIGS. 4 to 6 are curves illustrating the dissolution characteristics of a modified ferrocolumbium addition agent.

It should be noted from FIG. 4 that after a graph is produced, additional information is added thereto by hand, such as information indicating the start of dissolution and also the completion thereof.

Figure 5:
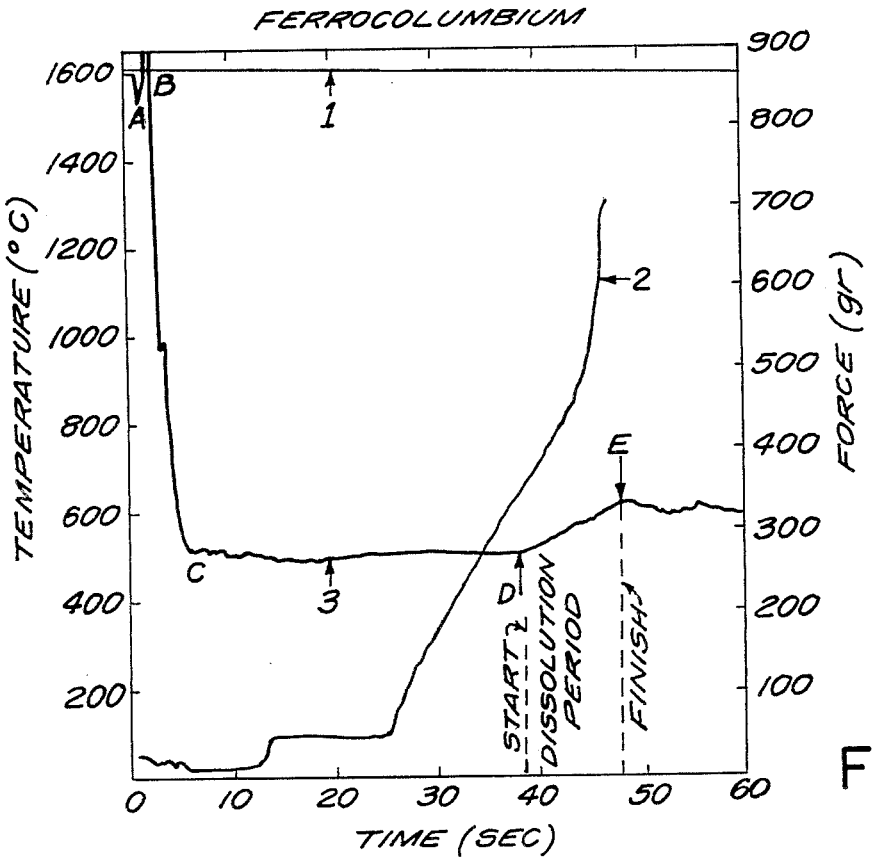
Figure 6:
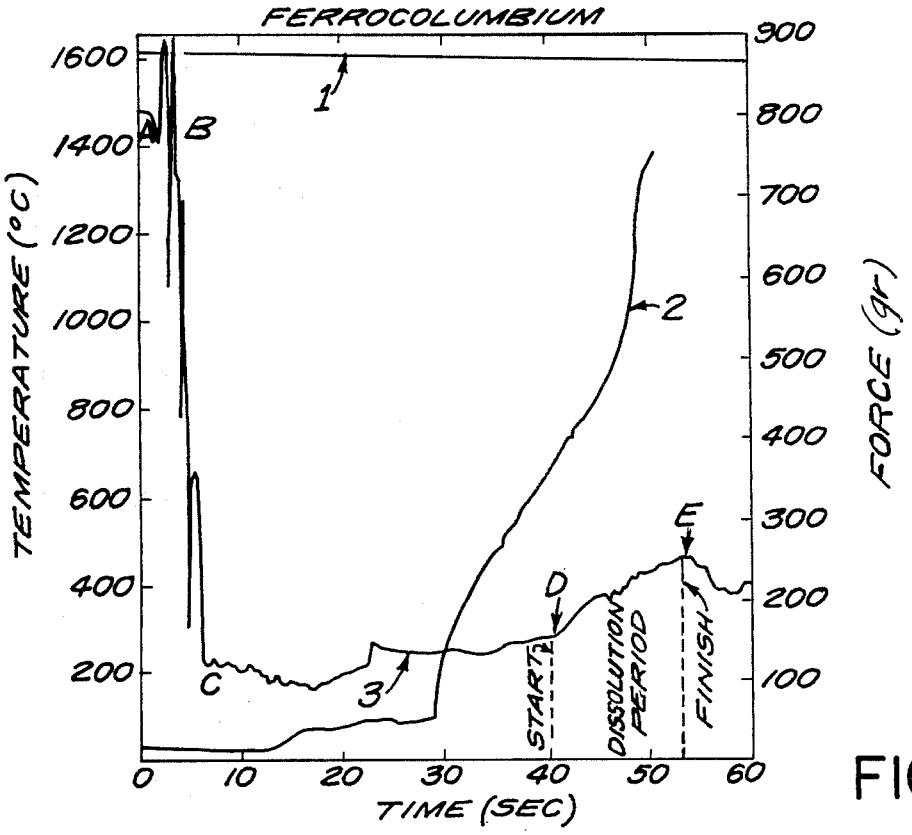

The results obtained are illustrated in FIGS. 4, 5 and 6 which show the dissolution characteristics of ferrocolumbium when the alloy is mixed with powdered iron and compacted. In each of the figures, curve 1 shows the temperature of the steel bath over the time period during which each of the tests was conducted, the temperature falling very slightly due to the fact that the power was turned off during the dissolution experiments. Curve 2 depicts the temperature in the center of the ferrocolumbium-iron compact (note FIG. 2) during the time of dissolution.

As will be noted from FIGS. 4 to 6, the temperature of the compact does not increase up to about the 25th second. This is believed to be due to the fact that there is moisture in the compact which takes time to evaporate. Following this period, the temperature starts to increase and does so rapidly. Curve 3 depicts the apparent weight of the compact during the experimental run. The sgement AB shows the initial weight of the compact prior to immersion in the liquid steel.

During the period of immersion of the compact as shown by segment BC of Curve 3, the apparent weight as measured by the weight sensor or load cell tends to decrease. This is due to the fact that, during this period, the steel cylinder surrounding the compact melts and the temperature of the compact increases as shown by Curve 2. The dissolution of the compact starts at about the 40th second as indicated by arrow D and finishes at about the 45th second as indicated by arrow E, a time span of only 5 seconds. This is due to the exothermic reaction of the mixture which markedly increases the dissolution rate of the ferrocolumbium alloy mixed with the iron powder.

Figure 7:
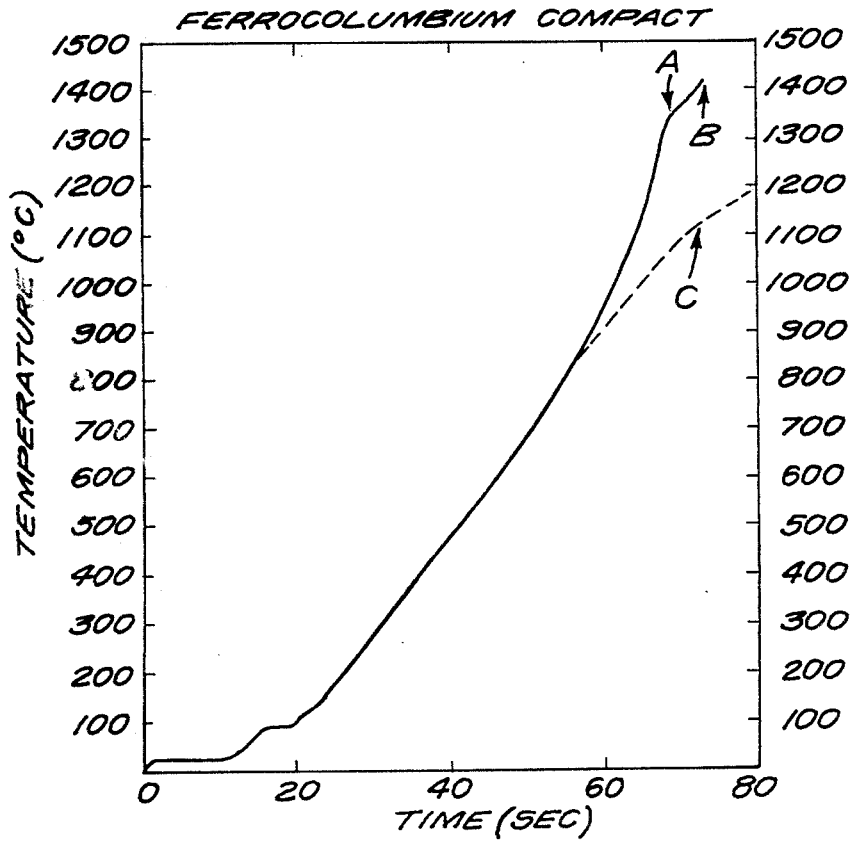
FIGS. 7 to 9 are curves showing the behavior characteristics of the modified ferrocolumbium addition agent when heated in air.
Figure 8:
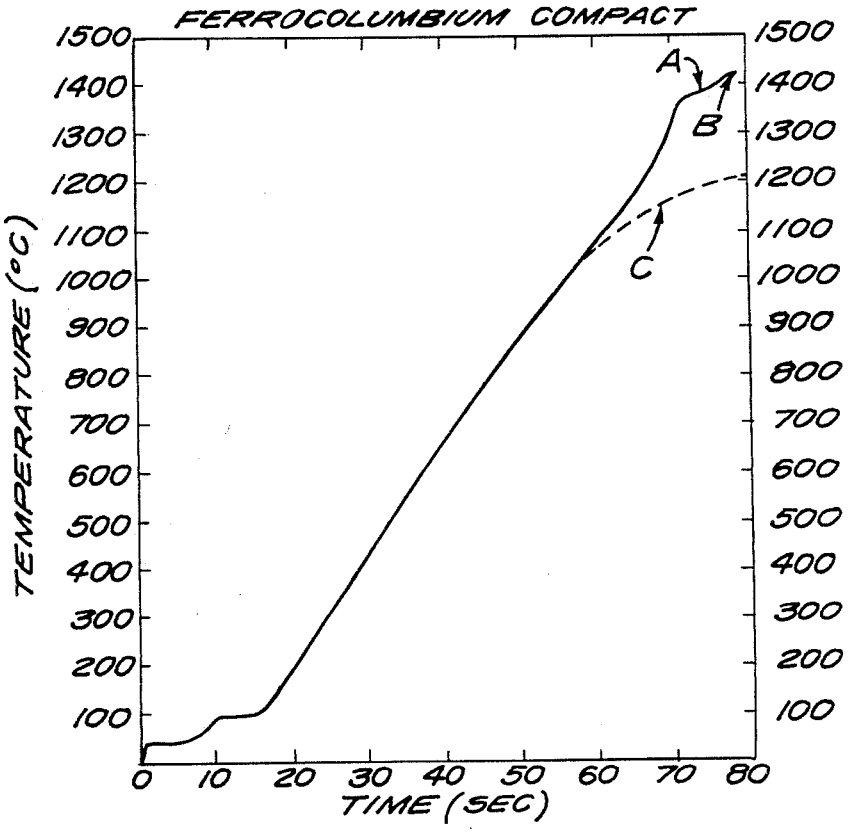
Figure 9:
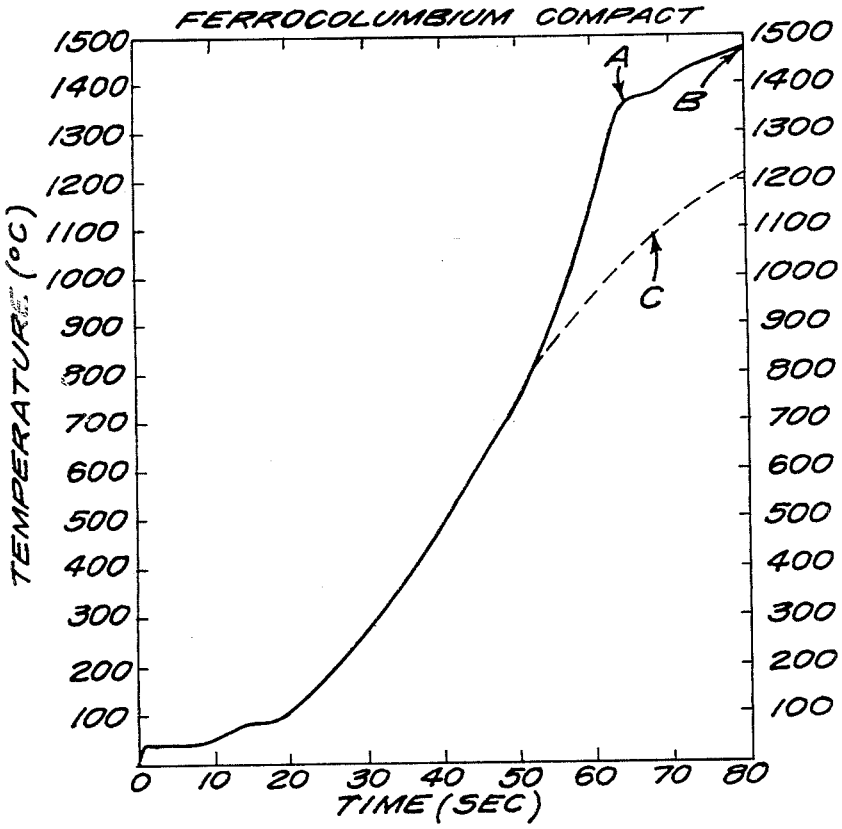

In addition to the test conducted in the liquid steel bath, the same ferrocolumbium-iron compact composition was heated in air using the induction furnace. The same measuring system was used to determine the temperature of the compact during heating. The results obtained are shown by the curves of FIGS. 7 to 9. As will be noted from each of the curves, the temperature increases very rapidly over a time span of approximately 60 seconds to the point indicated by arrow A, following which there is a slow down in the temperature increase at the point indicated by arrow B.

Figure 13:
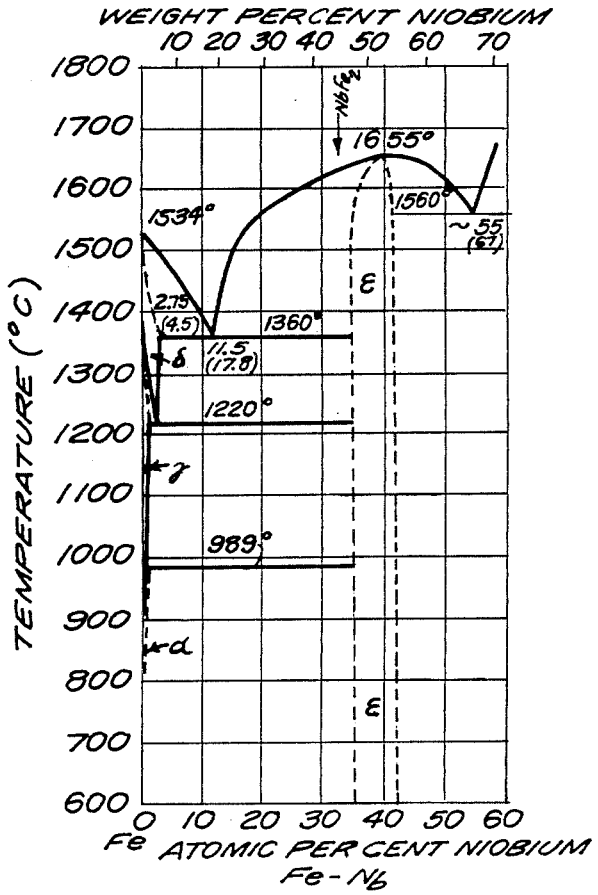
FIG. 13 is a binary diagram of the iron-niobium binary system (i.e., Fe-Cb) showing several eutectics and from which it will be noted that the melting points or ranges for an alloy containing over 50% to 70% niobium (columbium) are above the melting point of steel.

In all of the tests, the slow down or falling off in the temperature increase occurred at a temperature of about 1370° C.±10° C. which is the eutectic temperature of the Fe-Cb binary as will be clearly apparent in FIG. 13. As will clearly appear from FIG. 7, the curve rises almost exponentially towards point A due to the exothermic reaction between the iron powder and the uncombined columbium in the alloy. During the experiments, the formation of the liquid eutectic results in erratic behavior of the thermocouple (note arrows A and B in each of FIGS. 7 to 9) due to the corrosive attack of the liquid eutectic on the thermocouple after a certain length of time which results in the destruction of the thermocouple. However, the time period over which the dissolution occurs is so short that fairly reproducible results are obtained before destruction of the thermocouple occurs.

Without the exothermic reaction, each of the temperature-time curves would have followed dotted curve portion C which shows the temperature to be normally expected during the test.

As is clearly apparent from FIGS. 4 to 6, the ferrocolumbium compact was dispersed very rapidly in the steel after 40 seconds. Actually the time is shorter than 40 seconds since the steel cylinder containing the compact consumes 15 seconds during the melting thereof. Thus, a compact without a steel shell would require much less time to dissolve in the liquid steel. This is supported by the air heating experiments typified by FIGS. 7 to 9. Indications are that the dissolution time is about 5 to 10 seconds long.

The eutectic liquid which forms at about 1370° C. triggers the exothermic reaction, although the reaction begins before the eutectic temperature is reached. It is this phenomenon that accelerates the dissolution of the ferrocolumbium alloy which when added to the steel bath alone has a much slower rate of dissolution. The dissolution of a compact of the invention of about one inch in diameter can be effected within a time period of about 5 to 10 seconds.

Such dissolution times are a marked improvement over the dissolution times or rates obtained with conventional cast iron-columbium alloys and generally will be at least one order of magnitude shorter than the time obtained with the conventional material. Because of this improvement, more consistent recoveries of the addition agent can be expected.

The difference in results between the compact of the invention and the conventional will be apparent from the following Example.

EXAMPLE 1A

The same ferrocolumbium alloy was employed as in Example 1 (Table I) except that the particulate alloy was compacted without adding iron powder to it. In other words, the compact was a non-modified ferrocolumbium alloy compact. The same tests were conducted.

Figure 10:
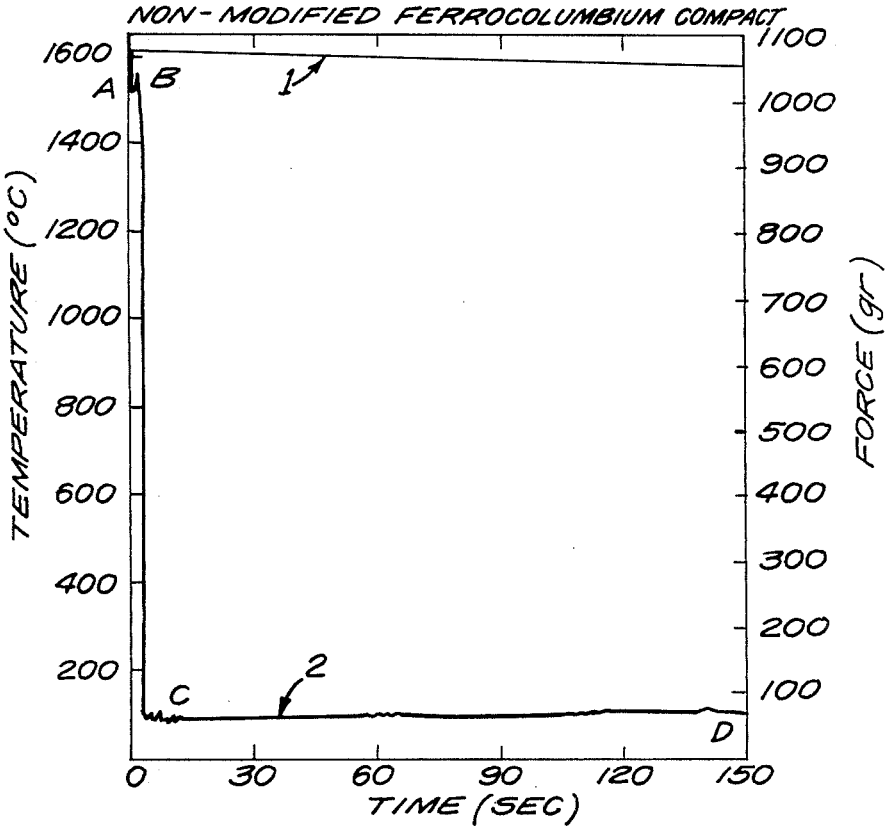
FIG. 10 depicts curves showing the dissolution characteristics of a compact of conventional ferrocolumbium addition alloy when added to molten steel.

FIG. 10 depicts the results for the dissolution of the non-modified compact. Curve 1 being the temperature of the steel over a time period of 150 seconds. The segment AB of Curve 2 shows the initial weight of the specimen prior to immersion. Segment 3C shows the apparent weight during immersion. As will be noted, the net force tends to decrease during this time due to buoyancy forces which tend to increase during immersion. The segment CD off Curve 2 has remained constant from over 5 seconds upwards to 150 seconds (point D), thus indicating that no dissolution of the ferrocolumbium compact has taken place during this period.

Figure 11:
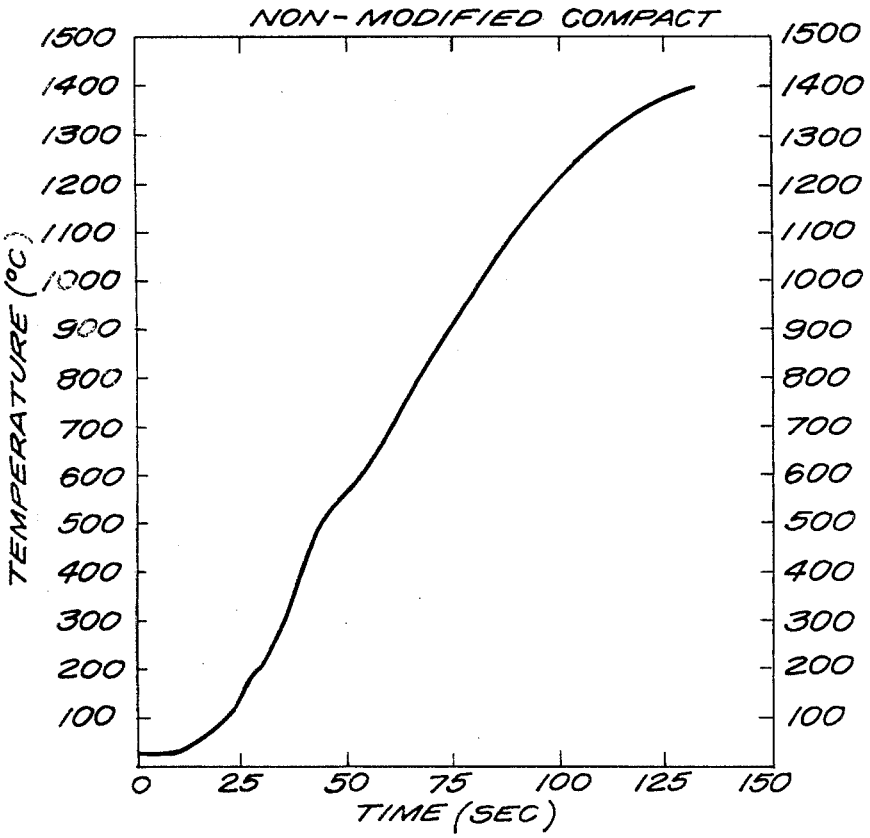
FIG. 11 shows the behavior characteristic of a compact of conventional ferrocolumbium addition alloy when heated in air.

As a further comparison, another non-modified ferrocolumbium compact of the same composition was heated in air by induction heating. This is shown in FIG. 11. To reach a temperature of between 1300° C. and 1400° C, a time period of 125 seconds was needed. As will be noted, the slope of this curve, unlike the slope of the curve of FIG. 7, decreases with time after about 30 seconds of heating, the heating characteristics of the non-modified composition being very different from the modified composition of the invention.

Figure 12:
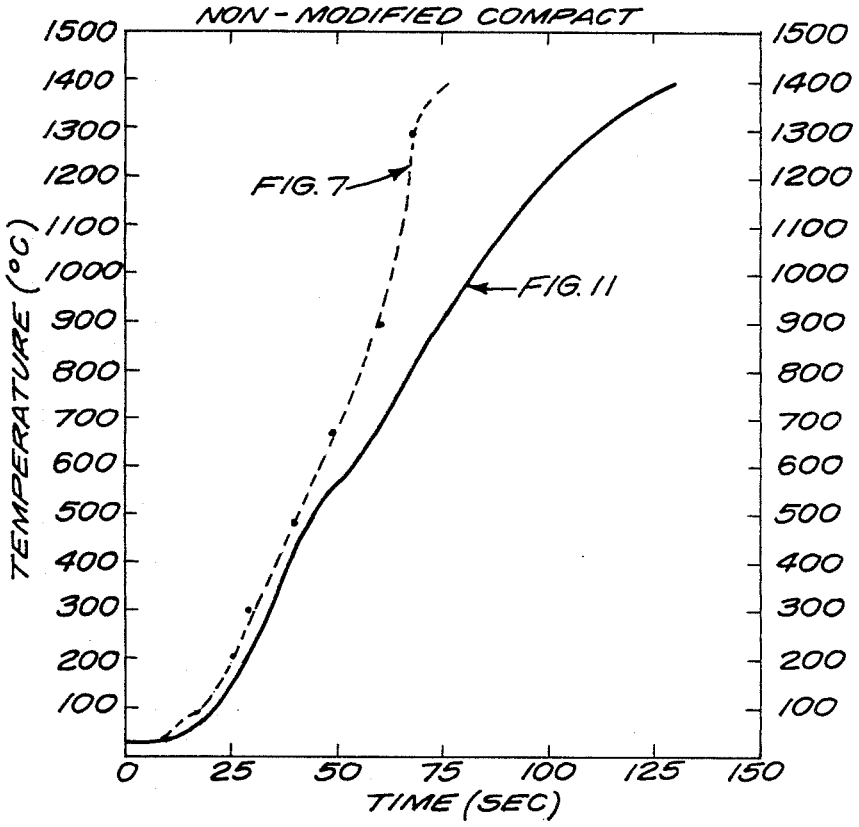
FIG. 12 depicts two curves comparing the heating characteristics of the modified ferrocolumbium addition alloy with those of the conventional ferrocolumbium alloy, the curves being taken from FIGS. 7 and 11, respectively.

This will be clearly apparent by referring to FIG. 12 in which the curve of FIG. 7 (dotted line) of the invention is compared to the curve of FIG. 11 outside the invention. Note that the temperature curve of FIG. 7 is almost exponential in its rise as compared to the curve of FIG. 11. The falling of the temperature of FIG. 7 at its peak at about 1360° (the eutectic temperature) is due to the latent heat of fusion.

As stated hereinbefore, the concept of the invention is particularly applicable to ferro-alloy systems in which there is at least one eutectic and at least one intermetallic compound as shown in FIG. 13 which is a phase diagram of the Fe-Cb binary system. (FIGS. 13, 14 and 15 are taken from Hansen's Constitution of Binary Alloys; McGraw-Hill Book Company, 1958).

Another eutectic binary is that shown in FIG. 14 which is a phase diagram of the Fe-Si system, ferrosilicon alloys being a common addition alloy. The method employed for the Fe-Cb system is applicable to the Fe-Si system.

Ferrocolumbium alloys are more difficult to dissolve in molten steel compared to other ferro-alloys. The invention is particularly applicable to ferrocolumbium alloys containing by weight about 50% to 90% columbium, e.g., 55 to 80% columbium, and the balance substantially iron. Commercial Fe-Cb addition alloys generally contain about 60% to 70% by weight columbium and the balance substantially iron.

In Example 1, the ferrocolumbium alloy employed contained 69.28%, the iron content taking into account Ta, Mn, Ti, Si, Sn, Al and C being about 22.95%. In the Example, 500 grams of the alloy was mixed with 302 grams of powdered iron. Thus, the percent iron in the mixture is raised to approximately 52% by weight. Ignoring the presence of the other elements which total about 7.78%, the 52% iron in the binary phase diagram (FIG. 13) places the alloy composition to the left of the peak temperature 1655° C. of the intermetallic compound such as to be in the region at which the eutectic prevails (1360° C.), the amount of the eutectic being small but being sufficient when liquid to accelerate the exothermic reaction which results in the characteristic heating curves shown in FIGS. 4 to 6, and as shown more startlingly by comparison to the heating curve of the non-modified Fe-Cb alloy in FIG. 12.

It should be noted that the invention is applicable to ferro-alloy systems that do not have eutectics, such as the iron-vanadium system illustrated by the phase diagram of FIG. 15. Vanadium is a well known additive in the production of high strength low alloy steels. In this instance, the commercial ferrovanadium alloy in the particulate form would be mixed with an exothermically reactable element which also is an additive in steelmaking, such as silicon. Since silicon is exothermically reactable with iron, as well as with vanadium, depending on the amounts present, the dissolution of the ferrovanadium alloy can be similarly accelerated by forming a compact of the mixture as was done with the ferrocolumbium alloy of Example 1.

Boron in small amounts is a common additive in the formulation of high strength nickel base alloys characterized by resistance to high temperature creep. Thus, a conventional nickel-boron addition alloy can be similarly treated to improve its rate of dissolution in the molten nickel-base alloy bath by mixing elemental nickel with the particulate nickel-boron alloy and forming a compact thereof.

In summary, the invention provides several ways in which conventional addition alloys can be improved insofar as dissolution rates are concerned.

Thus, one embodiment of the invention resides in an addition agent for molten metal baths comprising a P/M compact formed of a compacted mixture of a particulate primary addition alloy of an alloy system A-B (e.g., Fe-Cb, Fe-Si, etc) characterized by at least one eutectic and at least one intermetallic compound mixed with at least one metal powder selected from the group consisting of the metals A and B in which the selection of A or B powder in the compact is correlated to the composition of primary alloy AB such that where primary alloy AB contains substantial amounts of metal (e.g., Fe) which is not wholly stoichiometrically combined with metal B (e.g., Cb) as an intermetallic compound, substantially metal B powder (e.g., Cb) is employed in admixture with primary alloy AB, and where the primary alloy AB contains substantial amounts of metal B (e.g., Cb) which is not wholly stoichiometrically combined with metal A (e.g., Fe) as an intermetallic compound, substantially metal A powder (e.g., Fe) is employed in admixture with primary alloy AB, such that when the compacted mixture is added to the molten metal bath, the dissolution rate of the primary addition alloy is substantially increased over the dissolution rate of the same primary alloy AB when added to the molten bath alone.

Another embodiment of the invention resides in an addition agent for adding alloying ingredients to a molten steel bath comprising a P/M compact formed of a compacted mixture of a particular primary addition alloy and at least one secondary particulate metal selected from the group consisting of an elemental metal component and a binary alloy component, the primary particulate addition alloy being formed of a plurality of elemental metals at least one of which is present in substantial amounts and which primary addition alloy when added to the steel bath alone has a dissolution rate in said bath characteristic of said primary alloy, the at least one secondary particulate component being also an addition to the steel bath and being characterized by being exothermically reactable with the substantial amount of elemental metal in the primary addition alloy and thus capable of generating additional heat when the P/M compact is added to the molten steel bath, whereby the dissolution rate of the primary addition alloy in the compact is substantially increased over the characteristic dissolution rate of the same primary addition alloy when added to the steel bath alone.

A still further embodiment of the invention resides in an addition agent for adding alloying ingredients to a molten metal bath comprising a P/M compact formed of a compacted mixture of a particulate primary addition alloy (e.g., Fe-V alloy) and at least one secondary particulate elemental metal (e.g., Si), the primary particulate addition alloy comprising a plurality of elemental metals, at least one of which is present in substantial amounts, and which primary alloy when added to the molten metal bath alone has a dissolution rate characteristic of said alloy, the at least one secondary elemental metal (e.g., Si) being also an additive for the molten metal bath and characterized by being exothermically reactable with the substantial amounts of said alloying ingredient in said compact to generate additional heat when said P/M compact is added to the molten metal bath, whereby the dissolution rate of the primary addition alloy in the P/M compact is substantially increased as compared to the characteristic dissolution rate of the same primary alloy when added to the molten metal bath alone.

Thus, the secondary metal need not be one of the metals in the primary addition alloy so long as the secondary metal is capable of reacting exothermically with one of the metals in the primary alloy and is also one of the desired metals to be added to the molten metal bath. However, where a specific alloying composition is used, it may be desirable to use a secondary metal which is also present in the primary alloy but which is exothermically reactable with another element in the primary alloy which is not wholly combined as an intermetallic compound.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. An addition agent for molten metal baths comprising a P/M compact formed of a compacted mixture of a particulate primary addition alloy of an alloy system A-B characterized by at least one eutectic and at least one intermetallic compound mixed with at least one metal powder selected from the group consisting of metals A and B, said metals being exothermically reactable one with the other.

the selection of A or B powder in the compact being correlated to the composition of primary alloy AB such that where primary alloy AB contains a substantial amount of metal A which is not wholly stoichiometrically combined with metal B as an intermetallic compound, substantially metal B powder is employed in admixture with primary alloy AB, and where the primary alloy AB contains a substantial amount of metal B which is not wholly stoichiometrically combined with metal A as an intermetallic compound, substantially metal A powder is employed in admixture with primary alloy AB, such that when the compacted mixture is added to the molten metal bath, the dissolution rate of the primary addition alloy is substantially increased over the dissolution rate of the same primary alloy AB when added to the molten bath alone.

2. The addition agent of claim 1, wherein the primary addition alloy is a ferro-alloy for use in molten steel baths.

3. The addition agent of claim 2, wherein the ferro alloy is an iron-columbium alloy, wherein when said alloy contains a substantial amount of iron which is not wholly stoichiometrically combined with columbium as an intermetallic compound, substantially columbium powder is employed in the mixture, and wherein the alloy contains a substantial amount of columbium which is not wholly stoichiometrically combined with iron as an intermetallic compound, substantially iron powder is employed in the mixture.

4. The addition agent of claim 3, wherein the ferro-alloy has a composition ranging by weight from about 50% to 90% columbium.

5. The addition agent of claim 4, wherein the ferro-alloy has a composition ranging by weight from about 55% to 80% columbium.

6. The addition agent of claim 4, wherein the ferro-alloy has a composition ranging by weight of about 60% to 70% columbium.

7. An addition agent for molten steel baths comprising a P/M compact formed of a compacted mixture of a particulate primary addition alloy of iron-columbium characterized by at least one eutectic and at least one intermetallic compound mixed with at least one metal powder selected from the group consisting of iron and columbium, the selection of iron or columbium powder in the compact being correlated to the composition of the primary alloy such that where the primary alloy contains a substantial amount of iron which is not wholly stoichiometrically combined with columbium as an intermetallic compound, substantially columbium powder is employed in admixture with the particulate primary alloy.

and where the primary alloy contains a substantial amount of columbium which is not wholly stoichiometrically combined with iron as an intermetallic compound, substantially iron powder is employed in admixture with the particulate primary alloy, such that when the compacted mixture is added to a molten steel bath, the dissolution rate of the primary addition alloy is substantially increased over the dissolution rate of the same primary alloy when added to the molten bath alone.

8. The addition agent of claim 7, wherein the ferro-alloy contains by weight about 50% to 90% columbium and the balance substantially iron.

9. The addition agent of claim 8, wherein the ferro-alloy contains by weight about 55% to 80% columbium.

10. The addition agent of claim 8, wherein the ferro-alloy contains by weight about 60% to 70% columbium.

11. An addition agent for adding alloying ingredients to a molten steel bath comprising a P/M compact formed of a compacted mixture of a particulate primary addition alloy and at least one secondary particulate metal selected from the group consisting of an elemental metal component and a binary alloy component, said primary particulate addition alloy being formed of a plurality of elemental metals at least one of which is present in substantial amounts and which primary addition alloy when added to the steel bath alone has a dissolution rate in said bath characteristic of said primary alloy, said at least one secondary particulate component being also an addition to said steel bath and being characterized by being exothermically reactable with said substantial amount of elemental metal in said primary addition alloy and thus capable of generating additional heat when said P/M compact is added to the molten steel bath, whereby the dissolution rate of said primary addition alloy in the compact is substantially increased over the characteristic dissolution rate of the same primary addition alloy when added to the steel bath alone.

12. The addition agent of claim 11, wherein the primary addition alloy is a ferro-alloy.

13. The addition agent of claim 12, wherein the secondary particulate metal is one that is exothermically reactable with one of the metals making up the ferro-alloy.

14. The addition agent of claim 13, wherein the ferro-alloy is an alloy system characterized by at least one eutectic and at least one intermetallic compound.

15. The addition agent of claim 14, wherein the ferro-alloy is an iron-columbium alloy, wherein when said alloy contains a substantial amount of iron which is not wholly stoichiometrically combined with columbium as an intermetallic compound, substantially columbium powder is employed in the mixture, and wherein the alloy contains a substantial amount of columbium which is not wholly stoichiometrically combined with iron as an intermetallic compound, substantially iron powder is employed in the mixture.

16. The addition agent of claim 15, wherein the ferro-alloy has a composition ranging by weight from about 50% to 90% columbium.

17. The addition agent of claim 16, wherein the ferro-alloy has a composition ranging by weight from about 55% to 80% columbium.

18. The addition agent of claim 16, wherein the ferro-alloy has a composition ranging by weight of about 60% to 70% columbium.

19. An addition agent for adding alloying ingredients to a molten metal bath comprising a P/M compact formed of a compacted mixture of a particulate primary addition alloy and at least one secondary particulate elemental metal, said primary particulate addition alloy comprising a plurality of elemental metals, at least one of which is present in substantial amounts, and which primary alloy when added to the molten metal bath alone has a dissolution rate characteristic of said alloy, said at least one secondary elemental metal being also an additive for said molten metal bath and characterized by being exothermically reactable with said substantial amounts of said alloying ingredient in said compact to generate additional heat when said P/M compact is added to the molten metal bath, whereby the dissolution rate of said primary addition alloy in said P/M compact is substantially increased as compared to the characteristic dissolution rate of the same primary alloy when added to the molten metal bath alone.

20. The addition agent of claim 19, wherein said secondary particulate metal is not one of the elemental metals in the primary addition alloy.

21. The addition agent of claim 19, wherein said primary addition alloy is a ferro-alloy.

22. The addition agent of claim 21, wherein said secondary particulate metal is not one of the elements making up said ferro-alloy.

23. The addition agent of claim 19, wherein said primary addition alloy is a ferro-alloy, the alloy system of which has at least one eutectic and at least one intermetallic compound.

24. The addition agent of claim 23, wherein said secondary particulate metal is one of the elements making up the ferro-alloy.

25. The addition agent of claim 23, wherein the ferro-alloy is an iron-columbium alloy, wherein the secondary metal is one of said elements of iron and columbium, wherein when said alloy contains a substantial amount of iron which is not wholly stoichiometrically combined with columbium as an intermetallic compound, substantially columbium powder is employed in the mixture, and wherein the alloy contains a substantial amount of columbium which is not wholly stoichiometrically combined with iron as an intermetallic compound, substantially iron powder is employed in the mixture.

26. The addition agent of claim 25, wherein the ferro-alloy has a composition ranging by weight from about 50% to 90% columbium.

27. The addition agent of claim 26, wherein the ferro-alloy has a composition ranging by weight from about 55% to 80% columbium.

28. The addition agent of claim 26, wherein the ferro-alloy has a composition ranging by weight of about 60% to 70% columbium.

29. A method for alloying a molten metal bath which comprises, forming a P/M compact comprised of a compacted mixture of a particulate primary addition alloy of an alloy system A-B characterized by at least one eutectic and at least one intermetallic compound mixed with at least one metal powder selected from the group consisting of metals A and B, the selection of A or B powder in the compact being correlated to the composition of primary alloy AB such that where primary alloy AB contains a substantial amount of metal A which is not wholly stoichiometrically combined with metal B as an intermetallic compound, substantially metal B powder is employed in admixture with primary alloy AB, and where the primary alloy AB contains a substantial amount of metal B which is not wholly stoichiometrically combined with metal A as an intermetallic compound, substantially metal A powder is employed in admixture with primary alloy AB, and introducing said P/M compact into said molten metal bath, whereby the dissolution rate of the primary addition alloy is substantially increased over the dissolution rate of the same primary alloy AB when added to the molten bath alone.

30. The method of claim 29, wherein the primary addition alloy in the compact is a ferro-alloy for use in molten steel baths.

31. The method of claim 30, wherein the ferro-alloy employed is an iron-columbium alloy, wherein when said alloy contains a substantial amount of iron which is not wholly stoichiometrically combined with columbium as an intermetallic compound, substantially columbium powder is employed in the mixture, and wherein the alloy contains a substantial amount of columbium which is not wholly stoichiometrically combined with iron as an intermetallic compound, substantially iron powder is employed in the mixture.

32. The method of claim 31, wherein the ferro-alloy has a composition ranging by weight from about 50% to 90% columbium.

33. The method of claim 32, wherein the ferro-alloy has a composition ranging by weight from about 55% to 80% columbium.

34. The method of claim 32, wherein the ferro-alloy has a composition ranging by weight of about 60% to 70% columbium.

35. A method for allowing a molten steel bath which comprises, forming a P/M compact comprised of a mixture of a particulate primary addition alloy of iron-columbium characterized by at least one eutectic and at least one intermetallic compound mixed with at least one metal powder selected from the group consisting of iron and columbium, the selection of iron or columbium powder in the compact being correlated to the composition of the primary alloy such that where the primary alloy contains a substantial amount of iron which is not wholly stoichiometrically combined with columbium as an intermetallic compound, substantially columbium powder is employed in admixture with the particulate primary alloy, and where the primary alloy contains a substantial amount of columbium which is not wholly stoichiometrically combined with iron as an intermetallic compound, substantially iron powder is employed in admixture with the particulate primary alloy, and introducing said P/M compact into said molten steel bath, whereby the dissolution rate of the primary addition alloy is substantially increased over the dissolution rate of the same primary alloy when added to the molten steel alone.

36. The method of claim 35, wherein the ferro-alloy contains by weight about 50% to 90% columbium and the balance substantially iron.

37. The method of claim 36, wherein the ferro-alloy contains by weight about 55% to 80% columbium.

38. The method of claim 36, wherein the ferro-alloy contains by weight about 60% to 70% columbium.

39. A method for alloying a molten steel bath which comprises, forming a P/M compact formed of a compacted mixture of a particulate primary addition alloy and at least one secondary particulate metal selected from the group consisting of an elemental metal component and a binary alloy component, said primary particulate addition alloy being formed of a plurality of elemental metals at least one of which is present in substantial amounts and which primary addition alloy when added to the steel bath alone has a dissolution rate in said bath characteristic of said primary alloy, said at least one secondary particulate component being also an addition to said steel bath and being characterized by being exothermically reactable with said substantial amount of elemental metal in said primary addition alloy and thus capable of generating additional heat when said P/M compact is added to the molten steel bath, and introducing said P/M compact into said molten steel bath, whereby the dissolution rate of said primary addition alloy in the compact is substantially increased over the characteristic dissolution rate of the same primary addition alloy when added to the steel bath alone.

40. The method of claim 39, wherein the primary addition alloy is a ferro-alloy.

41. The method of claim 40, wherein the secondary particulate metal is one that is exothermically reactable with one of the metals making up the ferro-alloy.

42. The method of claim 41, wherein the ferro-alloy is an alloy system characterized by at least one eutectic and at least one intermetallic compound.

43. The method of claim 42, wherein the ferro-alloy is an iron-columbium alloy, wherein when said alloy contains a substantial amount of iron which is not wholly stoichiometrically combined with columbium as an intermetallic compound, substantially columbium powder is employed in the mixture, and wherein the alloy contains a substantial amount of columbium which is not wholly stoichiometrically combined with iron as an intermetallic compound, substantially iron powder is employed in the mixture.

44. The method of claim 43, wherein the ferro-alloy has a composition ranging by weight from about 50% to 90% columbium.

45. The method of claim 44, wherein the ferro-alloy has a composition ranging by weight from about 55% to 80% columbium.

46. The method of claim 44, wherein the ferro-alloy has a composition ranging by weight of about 60% to 70% columbium.

47. A method for alloying a molten metal bath which comprises forming a P/M compact comprised of a compacted mixture of a particulate primary addition alloy and at least one secondary particulate elemental metal, said primary particulate addition alloy comprising a plurality of elemental metals, at least one of which is present in substantial amounts, and which primary alloy when added to the molten metal bath alone has a dissolution rate characteristic of said alloy, said at least one secondary elemental metal being also an additive for said molten metal bath and characterized by being exothermically reactable with said substantial amounts of said alloying ingredient in said compact to generate additional heat when said P/M compact is added to the molten metal bath, and introducing said P/M compact into said molten metal bath, whereby the dissolution rate of said primary addition alloy in said P/M compact is substantially increased as compared to the characteristic dissolution rate of the same primary alloy when added to the molten metal bath alone.

48. The method of claim 47, wherein said secondary particulate metal is not one of the elemental metals in the primary addition alloy.

49. The method of claim 47, wherein said primary addition alloy is a ferro-alloy.

50. The method of claim 49, wherein said secondary particulate metal is not one of the elements making up said ferro-alloy.

51. The method of claim 47, wherein said primary addition alloy is a ferro-alloy, the alloy system of which has at least one eutectic and at least one intermetallic compound.

52. The method of claim 51, wherein said secondary particulate metal is one of the elements making up the ferro-alloy.

53. The method of claim 51, wherein the ferro-alloy is an iron-columbium alloy, wherein the secondary metal is one of said elements of iron and, columbium wherein when said alloy contains a substantial amount of iron which is not wholly stoichiometrically combined with columbium as an intermetallic compound, substantially columbium powder is employed in the mixture, and wherein the alloy contains a substantial amount of columbium which is not wholly stoichiometrically combined with iron as an intermetallic compound, substantially iron powder is employed in the mixture.

54. The method of claim 53, wherein the ferro-alloy has a composition ranging by weight from about 50% to 60% columbium.

55. The method of claim 54, wherein the ferro-alloy has a composition ranging by weight from about 55% to 80% columbium.

56. The method of claim 54, wherein the ferro-alloy has a composition ranging by weight of about 60% to 70% columbium.

* * * * *

UNITED STATES PATENT AND TRADEMARK OFFICE

CERTIFICATE OF CORRECTION

PATENT NO. : 4,472,196

DATED : September 18, 1984

INVENTOR(S) : STAVROS A. ARGYROPOULOS and PAUL D. DEELEY

It is certified that error appears in the above-identified patent and that said Letters Patent are hereby corrected as shown below:

Column 16, Claim 35, line 25, "allowing" should be --alloying--.

Column 18, Claim 54, line 44, "60%" should be --90%--.

Signed and Sealed this

*Sixteenth* Day of *July 1985*

[SEAL]

*Attest:*

DONALD J. QUIGG

*Attesting Officer* *Acting Commissioner of Patents and Trademarks*